US006800835B1

(12) United States Patent
Sims, III et al.

(10) Patent No.: US 6,800,835 B1
(45) Date of Patent: Oct. 5, 2004

(54) RADIO-FREQUENCY DRIVEN DIELECTRIC HEATERS FOR NON-NUCLEAR TESTING IN NUCLEAR CORE DEVELOPMENT

(75) Inventors: William Herbert Sims, III, New Market, AL (US); Thomas J. Godfroy, Ann Arbor, MI (US); Leo Bitteker, Los Alamos, NM (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/463,935

(22) Filed: Jun. 16, 2003

(51) Int. Cl.[7] ..... H05B 6/54

(52) U.S. Cl. ..... 219/780; 219/548; 219/553; 219/672

(58) Field of Search ..... 338/238, 274; 174/77 R, 102 P, 118; 219/538, 544, 546, 552, 553, 780, 542, 548, 550, 600, 601, 635, 672

(56) References Cited

U.S. PATENT DOCUMENTS

| | | | | | |
|---|---|---|---|---|---|
| 1,127,281 | A | * | 2/1915 | Read | 338/238 |
| 2,074,777 | A | * | 3/1937 | Coupier | 174/118 |
| 4,054,850 | A | | 10/1977 | Gerrish | |
| 4,304,974 | A | | 12/1981 | Ikeda et al. | |
| 4,673,783 | A | | 6/1987 | Igarashi et al. | |
| 5,453,599 | A | * | 9/1995 | Hall, Jr. | 219/544 |
| 5,575,941 | A | * | 11/1996 | Johnson | 219/544 |
| 5,973,308 | A | | 10/1999 | Sternowski | |
| 6,054,700 | A | | 4/2000 | Rokhvarger et al. | |
| 6,344,638 | B1 | | 2/2002 | Tomasello | |
| 6,444,966 | B2 | | 9/2002 | Mukumoto et al. | |

* cited by examiner

*Primary Examiner*—Tu Ba Hoang
(74) *Attorney, Agent, or Firm*—James J. McGroary; Michael G. Smith

(57) ABSTRACT

Apparatus and methods are provided through which a radio-frequency dielectric heater has a cylindrical form factor, a variable thermal energy deposition through variations in geometry and composition of a dielectric, and/or has a thermally isolated power input.

16 Claims, 8 Drawing Sheets

RADIO-FREQUENCY DRIVEN DIELECTRIC HEATERS FOR NON-NUCLEAR TESTING IN NUCLEAR CORE DEVELOPMENT

ORIGIN OF THE INVENTION

The invention described herein was made by employees of the United States Government and may be manufactured and used by or for the Government of the United States of America for governmental purposes without the payment of any royalties thereon or therefore.

FIELD OF THE INVENTION

This invention relates generally to beaters, and more particularly to a radio-frequency driven dielectric heater for use in non-nuclear testing in nuclear core development.

BACKGROUND OF THE INVENTION

Development of space nuclear power and propulsion systems is difficult and costly due to radiation-related health and safety problems during system testing. In order to reduce the health and safety problems, researchers have pursued means for non-nuclear testing of nuclear systems. The non-nuclear testing includes simulation of a nuclear reactor core with electrical heaters. Using a simulated reactor core, various characteristics of the nuclear system that are not directly related to the nuclear operation are tested.

Early stages of conventional nuclear system development utilized resistive electrical heater elements. The resistive electrical heater elements simulate nuclear reactor pins. Conventional resistive electrical heater elements are designed with the same form factor as the simulated nuclear reactor pins, namely a cylindrical structure with an outer metallic clad surrounding a graphite resistive element. The resistive electrical heater elements are bound in a hexagonal packing pattern to simulate the shape of the core structure of the nuclear reactor assembly. Other elements of the reactor design are also incorporated including heat transfer mechanisms, power conversion systems, radiators, and loads. However, the simulated core has thermal loss through the power leads that provide electrical power to the conventional resistance heaters.

Resistance heaters have nuclear pin diameters that are relatively large, greater than 0.5 inches. Power leads of the conventional resistive heaters require relatively large diameter wires to minimize losses in the leads. Since the power leads have electrical resistance, the current passing through the leads produces thermal energy in the leads. In order to minimize the thermal loss, larger diameter wires are used. However, as the lead wire diameter increases, two complications arise. First, the physical placement of the power leads entering the simulated core is problematic. Second, the conduction of thermal energy out of the core via the power leads increases, resulting in a less robust simulation of the nuclear reactor core.

Later reactor designs require smaller pin diameters, such as less than 0.5 inches, and require more pins, such as hundreds, for higher power systems, further exacerbating these problems. These requirements make the use of resistance heaters less attractive.

Inductive heating is commonly used for applications where a metallic structure must be heated. In general, inductive heating uses a coil that carries alternating current (AC) to produce an alternating magnetic field in the test article. The magnetic field induces currents in the test article, which in turn produce thermal energy via resistive losses.

However, inductive heating requires high currents in the coil and hence large diameter power leads. Inductive heating also requires that the active heating element be metallic.

For the reasons stated above, and for other reasons stated below which will become apparent to those skilled in the art upon reading and understanding the present specification, there is a need in the art for a heater with reduced thermal coupling to the outside environment. There is also a need for a heater with a reduced size relative to the power leads. Furthermore, there is a need to generate high thermal energy in a relatively small space to simulate fission reactions for non-nuclear testing in nuclear core development. The above-mentioned shortcomings, disadvantages and problems are addressed by the present radio-frequency driven dielectric heater, which will be understood by reading and studying the following specification.

SUMMARY OF THE INVENTION

A cylindrical radio-frequency (RF) driven dielectric heater includes a conductor, surrounded by a dielectric, which is in turn surrounded by a Faraday shield. An RF electromagnetic field generated by the conductor is dissipated by the dielectric, converting an RF signal into thermal energy. The thermal energy is conducted outward from the RF driven dielectric heater. The Faraday shield confines the RF electromagnetic energy within the perimeter of the RF driven dielectric heater. The RF driven dielectric heater can be made smaller than conventional heaters. The conductor of the RF driven dielectric heater can receive the RF signal either capacitively or inductively, thus requiring no physical coupling for delivery of the RF signal to the RF driven dielectric heater and reducing the thermal coupling. to the outside environment.

The present RF driven dielectric heater describes systems, methods, and apparatus of varying scope. In addition to the aspects and advantages of the present RF driven dielectric heater described in this summary, further aspects and advantages of the RF driven dielectric heater will become apparent by reference to the drawings and by reading the detailed description that follows.

DETAILED DESCRIPTION OF THE INVENTION

In the following detailed description of embodiments of the radio-frequency driven dielectric heater, reference is made to the accompanying drawings that form a part hereof, and in which is shown by way of illustration specific embodiments in which the radio-frequency driven dielectric heater may be practiced. These embodiments are described in sufficient detail to enable those skilled in the art to practice the radio-frequency driven dielectric heater, and it is to be understood that other embodiments may be utilized and that logical, mechanical, electrical and other changes may be made without departing from the scope of the present radio-frequency driven dielectric heater. The following detailed description is, therefore, not to be taken in a limiting sense, and the scope of the present radio-frequency driven dielectric heater is defined only by the appended claims.

RF dielectric heating techniques utilize a rapidly fluctuating electromagnetic field which applies an alternating torque on polar molecules in a material under test. This torque either causes the molecules to flip orientation or to attempt to flip orientation, depending on the material. As a result, thermal energy is produced via the frictional resistance to the molecules motion. This technique is commonly used to heat nonmetallic materials in a very controlled manner including plastics, ceramics, and food products. The effectiveness of the heating process is dependent on the dielectric properties of the test article. Similarly, the ideal choice of frequency of the electromagnetic field is based on the electrical properties of the material. Materials that are very efficient at converting the RF power to thermal power are termed lossy dielectrics, In some embodiments, RF energy source transmitters are limited to a number of predetermined frequencies. The dielectric constant of materials (e.g., graphite, nuclear pellets, soils, etc.) varies with the frequency that is applied to the subject material. For any given RF frequency, various subject materials are likely to have various different dielectric constants. For example, the impedance of a conventional system has been observed to vary depending on the frequency to which the RF source is tuned and with soil. See, Garbe Et. Al.; "Calculation of Electromagnetically and Thermally Coupled Fields In Real Soil Decontamination"; $15^{th}$ International Wroclaw Symposium on EMC, 2000.

Figure 1:
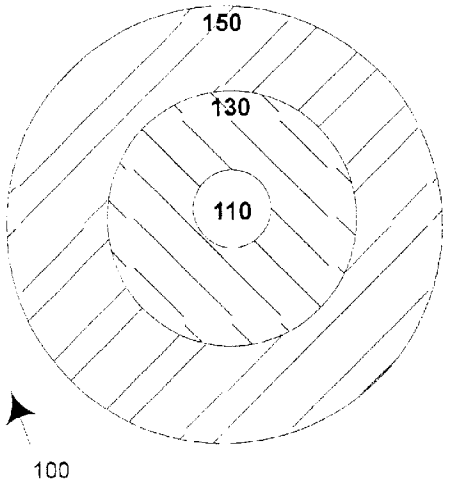
FIG. 1 is a block diagram of an apparatus implementation of a radio-frequency driven dielectric heater having an insulating dielectric.
Figure 1:
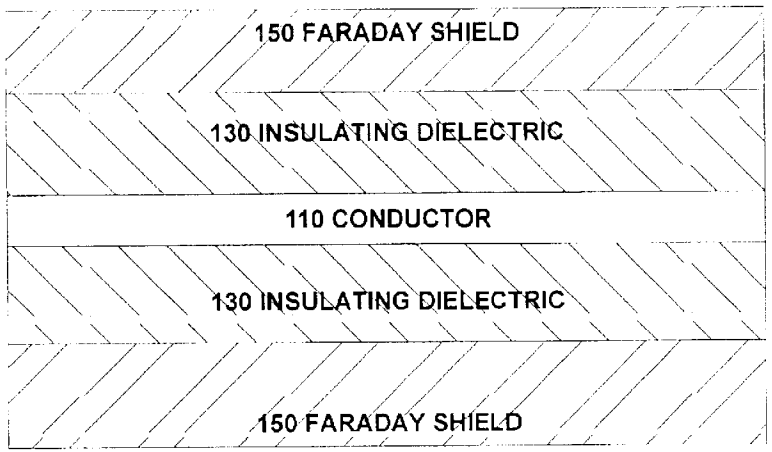

FIG. 1 is a block diagram of an apparatus implementation of a radio-frequency (RF) driven dielectric heater 100. The RF driven dielectric heater 100 is also known as a rod or a pin.

The RF driven dielectric heater 100 includes a cylindrical conductor 110. Examples of the conductor 110 include an antenna, a wire, or any other combination. A signal transmission source (not shown) passes an RF signal into the conductor 110, generating an RF electromagnetic field (not shown).

The conductor 110 is further surrounded by an insulating dielectric 130. An insulating dielectric is a dielectric that has electrical insulating properties. The RF electromagnetic field readily passes from the conductor 110 and into the insulating dielectric 130.

The RF electromagnetic field is dissipated by the insulating dielectric 130. The RF electromagnetic energy causes rapid fluctuations in the orientation of molecules in the insulating dielectric 130, converting the RF electromagnetic energy into thermal energy. The thermal energy is conducted outward from the insulating dielectric 130.

In some embodiments, the insulating dielectric 130 includes zirconia, a carbide, and/or titania. In some other embodiments, the insulating dielectric 130 includes a non-metallic depleted nuclear fuel, which in various examples can take the form of powder, rods, pellets, liquid and/or gas. The non-metallic depleted nuclear fuel allows precise simulation of thermal energy transfer and thermodynamic properties.

The insulating dielectric 130 is surrounded by a Faraday shield 150. The Faraday shield 150 provides a system ground for the RF electromagnetic energy and confines the RF electromagnetic energy within the perimeter of the RF driven dielectric heater 100. A Faraday shield is also known as a Faraday cage.

In some embodiments, the Faraday shield 150 is comprised of a refractory metal, such as tungsten, tantalum, molybdenum and/or osmium. In other embodiments, the Faraday shield 150 is comprised of a non-refractory metal such as aluminum or copper.

The conductor 110 is an active radiator of electromagnetic energy. The electromagnetic energy has the ability to deliver energy into the surrounding environment, or other dielectric heaters when more than one is being used.

The insulating dielectric 130 substantially prevents a short circuit from forming between conductor 110 and the Faraday shield 150. For these reasons the insulating dielectric 130 can not be electrically conductive, but must have some dielectric loss.

In some embodiments, the RF driven dielectric heater 100 simulates fission thermal energy in a nuclear reactor for non-nuclear testing in nuclear core development. In those embodiments, the insulating dielectric 130 can be selected to match the thermal characteristics of the nuclear material that is simulated in order to accurately simulate thermodynamics and thermal energy transfer effects and properties of the thermodynamically simulated nuclear material. In some embodiments, the RF energy source ranges from 2,000 to 5,000 volts with RF frequencies up to 50 MHz. Those of ordinary skill in the art would understand that the selection of voltage and frequency is a function of the materials of the conductor 110, the dielectric 130 and the Faraday shield 150.

RF dielectric heating has several advantages over other techniques for application to non-nuclear testing of nuclear systems. Unlike resistive and inductive heating techniques, dielectric heating techniques depend on high field potential at low current to produce thermal energy. Therefore, smaller diameter power leads can be used to transmit the RF signal for the frequency range of interest, typically less than 100 MHz. The Faraday shield 150 provides a return path for the RF signal, therefore only a single power lead is required. Nuclear fuels are typically in the form of ceramic compounds. Therefore, the simulated reactor pin can use depleted forms of the nuclear fuel material as the dielectric material resulting in precise matching of thermodynamic and material characteristics, as shown in figures below.

Figure 2:
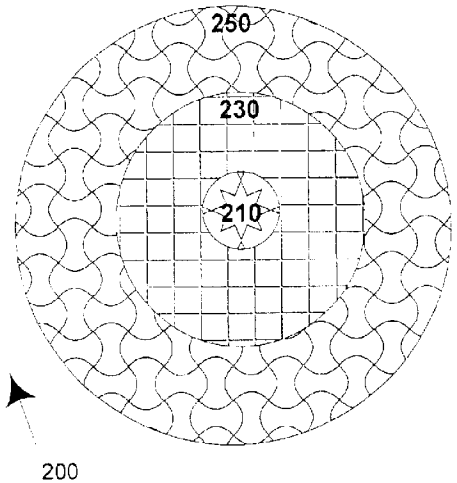
FIG. 2 is a block diagram of an apparatus implementation of a radio-frequency driven dielectric heater having an insulating dielectric and having layers that comprise certain materials.
Figure 2:
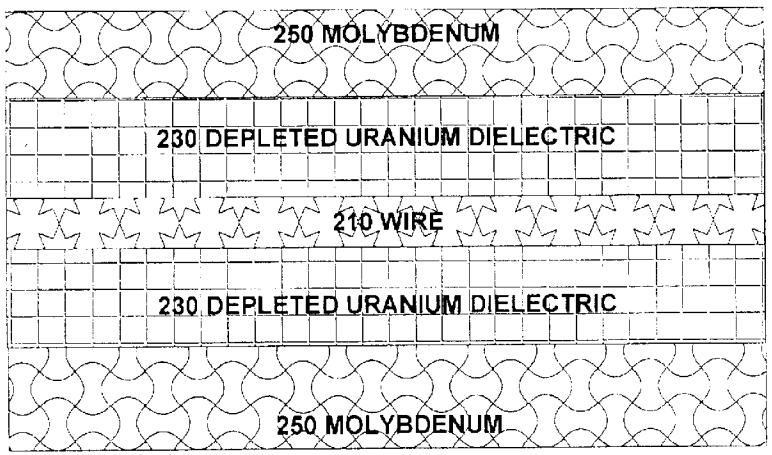

Particular implementations of the RF driven dielectric heater 100 are described below in FIGS. 2–5. FIG. 2 is a block diagram of an apparatus implementation of a RF driven dielectric heater 200 having an insulating dielectric and having layers that comprise certain materials. In the RF driven dielectric heater 200, the conductor 110 of FIG. 1 is a wire 210. Furthermore, the insulating dielectric 130 of FIG. 1 is a depleted uranium oxide ($UO_2$.) dielectric 230. Lastly, the Faraday shield 150 of FIG. 1 is a molybdenum tube 250.

The depleted uranium oxide dielectric 230 obviates the need for an insulator around the dielectric. The depleted uranium oxide dielectric 230 is a substantial insulator. Thus, no short will develop between the wire 210 and the molybdenum tube 250. Therefore, no insulator is required between the wire 210 and the depleted uranium oxide dielectric 230, and no insulator is required between the depleted uranium oxide dielectric 230 and the molybdenum tube 250. Thus, a RF signal is supplied to the conductor 110 which radiates into the depleted uranium oxide dielectric 230 at a resonant frequency, yielding thermal energy.

In some embodiments, the RF driven dielectric heater 100 has a diameter of approximately 0.125" as required in high power fission core applications. Thus, the RF driven dielectric heater 200 provides a RF driven dielectric heater with high thermal output, relatively small physical size and a simplified construction that requires no insulators surrounding the depleted uranium oxide dielectric 230.

Figure 3:
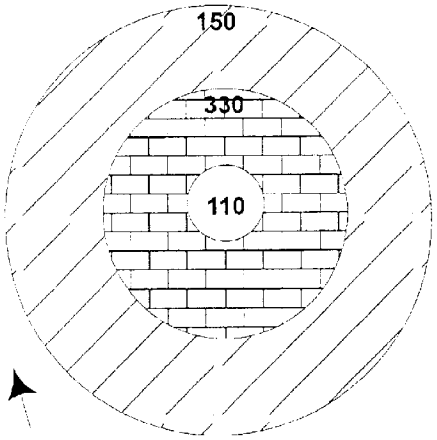
FIG. 3 is a block diagram of an apparatus implementation of a radio-frequency driven dielectric heater having an insulating dielectric that varies along an axial dimension.
Figure 3:
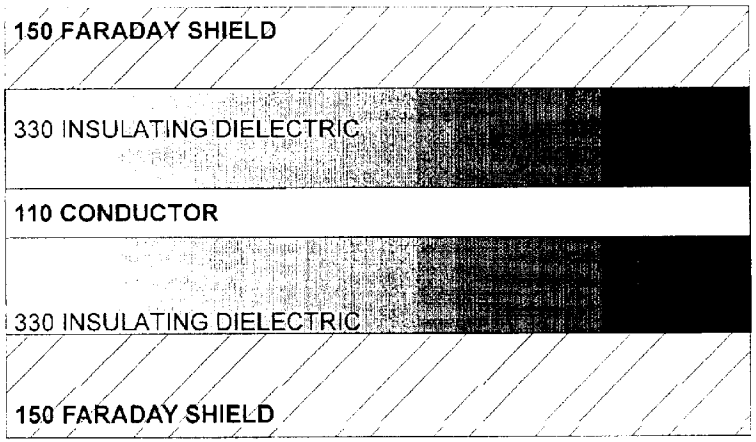
Figure 4:
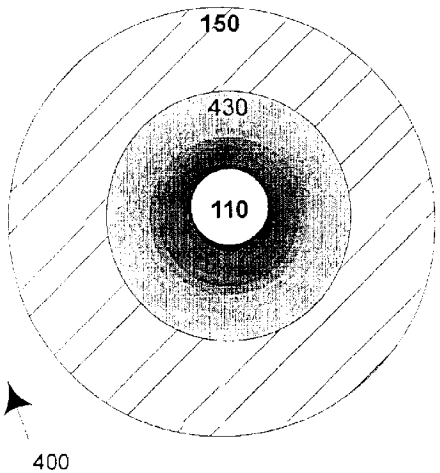
FIG. 4 is a block diagram of an apparatus implementation of a radio-frequency driven dielectric heater having an insulating dielectric that varies along a radial dimension.
Figure 4:
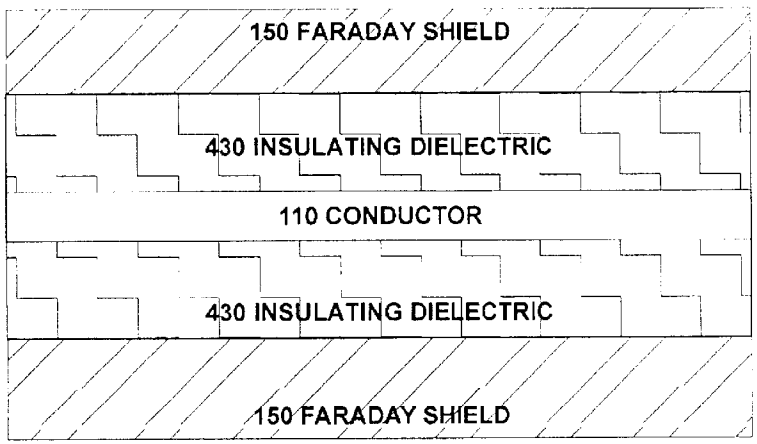
Figure 5:
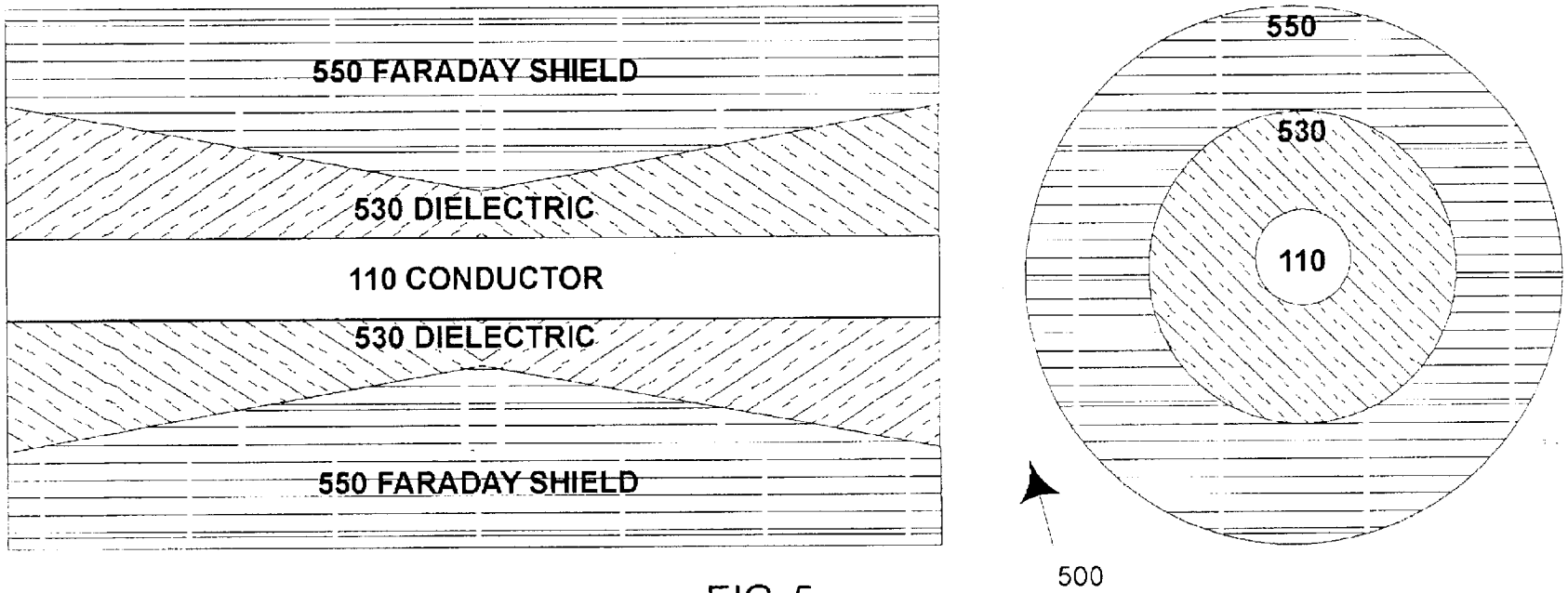
FIG. 5 is a block diagram of an apparatus implementation of a radio-frequency driven dielectric heater having an insulating dielectric that varies geometrically along a dimension.

FIGS. 3–5 show RF driven dielectric heaters having an insulating dielectric with a variable thermal energy deposition. The variable thermal energy deposition results from variations in impedance of the insulating dielectric. Variation in the impedance of the insulating dielectric is achieved through a variation of at least one characteristic of the insulating dielectric along at least one dimension. The characteristics include the density profile and the geometry of the dielectric. The dimensions include a radial dimension and an axial dimension. One example of varying density is creating or forming air pockets or vacuum pockets in position(s) or area(s) of the dielectric where different thermal energy deposition is desired. The air or vacuum pockets have dielectric properties that are taken into account in a design of a RF driven dielectric heater, but the effect is to alter the dielectric properties on a local level. One example of varying geometry is varying the thickness of the dielectric.

FIG. 3 is a block diagram of an apparatus implementation of a RF driven dielectric heater 300 having an insulating dielectric that varies along an axial dimension. The RF driven dielectric heater 300 includes a conductor 110 and a Faraday shield 150 as in FIG. 1. However, the RF driven dielectric heater 300 also includes an insulating dielectric 330 that varies along an axial dimension. The insulating dielectric 330 varies in density of dielectric material along the axial dimension to create a thermal energy deposition that increases from one end of the axial dimension to the other end of the axial dimension.

FIG. 4 is a block diagram of an apparatus implementation of a radio-frequency driven dielectric heater 400 having an insulating dielectric that varies along a radial dimension. The RF driven dielectric heater 400 includes a conductor 110 and a Faraday shield 150 as in FIG. 1. However, the RF driven dielectric heater 400 also includes an insulating dielectric 430 that varies along a radial dimension. The insulating dielectric 430 varies in density of dielectric material outward from the center to create a thermal energy deposition that decreases outwardly from the center.

FIG. 5 is a block diagram of an apparatus implementation of a RF driven dielectric heater 500 having an insulating dielectric that varies geometrically along an axial dimension. The RF driven dielectric heater 500 includes a conductor 110 as in FIG. 1. However, the RF driven dielectric heater 500 also includes an insulating dielectric 530 that varies in thickness along an axial dimension. In one embodiment, the insulating dielectric 530 is thinner in the middle of the axial dimension to create a thermal energy deposition that is greatest in the middle along the axial dimension. This embodiment is particularly well-suited to simulate the thermal energy deposition of fission reactors that have the greatest thermal energy deposition in the middle along an axial dimension. The RF driven dielectric heater 500 also includes a Faraday shield 150 that inversely varies in thickness along an axial dimension corresponding to the variance in thickness of the dielectric 530.

Figure 6:
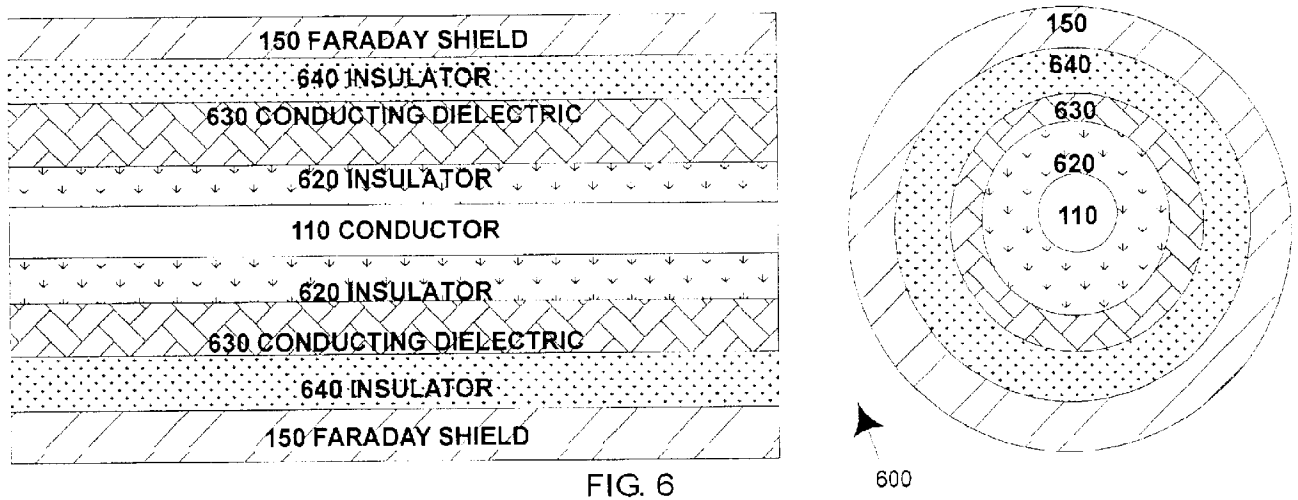
FIG. 6 is a block diagram of an apparatus implementation of a radio-frequency driven dielectric heater including insulators surrounding a conducting dielectric.

FIG. 6 is a block diagram of an apparatus implementation of a RF driven dielectric heater 600 including insulators surrounding a conducting dielectric. The RF driven dielectric heater 600 includes a conductor 110 that has a form factor (i.e. shape) that is cylindrical. A RF signal passes into the conductor 110.

The conductor 110 is surrounded by an inner insulator 620. The inner insulator 620 presents little impedance to an RF electromagnetic field that radiates from the conductor 110. Molecules in the inner insulator 620 readily flip back and forth with the alternating electromagnetic field produced by the RF signal in the conductor 110. Because the molecules in the inner insulator 620 flip orientation easily, the RF electromagnetic field readily passes from the conductor 110, through the inner insulator 620 and outward.

The inner insulator 620 is further surrounded by a conductive lossy dielectric 630. A conducting dielectric is a dielectric that has electrical conducting properties. The inner insulator 620 electrically isolates the conductor 110 from the dielectric 630. Notwithstanding the inner insulator 620 confining the RF signal in the conductor 110, an RF electromagnetic field radiates from the conductor 110 through the inner insulator 620 and into the conducting dielectric 630. One example of a conducting dielectric material is graphite as discussed below in conjunction with FIG. 7.

The conducting dielectric 630 is surrounded by an outer insulator 640. The inner insulator 620 may be made from the same materials as the outer insulator 640, but not necessarily. The outer insulator 640 is surrounded by a Faraday shield 150.

In some embodiments either of the insulators 620 and 640 comprise a very efficient dielectric (i.e. not lossy) material in order to minimize loss of the RF electromagnetic energy in the insulator. In some other embodiments, either of the insulators 620 and 640, have insulating properties, as well as sufficient material strength, at an expected maximum operating temperature. In yet other embodiments, either of the insulators 620 and 640 are chemically compatible with the adjoining materials over a range of expected operating conditions. Examples of materials that either of the insulators 620 and 640 are composed of include oxides and/or oxide compounds (e.g. alumina, silica and magnesia), polymers, carbides, nitrides.

An electrical RF signal (not shown) is received by the conductor 110. The insulators 620 and 640 on both sides of the insulating dielectric 630 prevent the signal in the conductor from electrically shorting to the Faraday shield 150. Absence of the insulators 620 and 640 would allow the RF signal to flow to the Faraday shield 150, which would in turn radiate RF electromagnetic energy outward. Thus, the insulators 620 and 640 help confine energy within the heater 600, which increases the efficiency of the heater 600.

Figure 7:
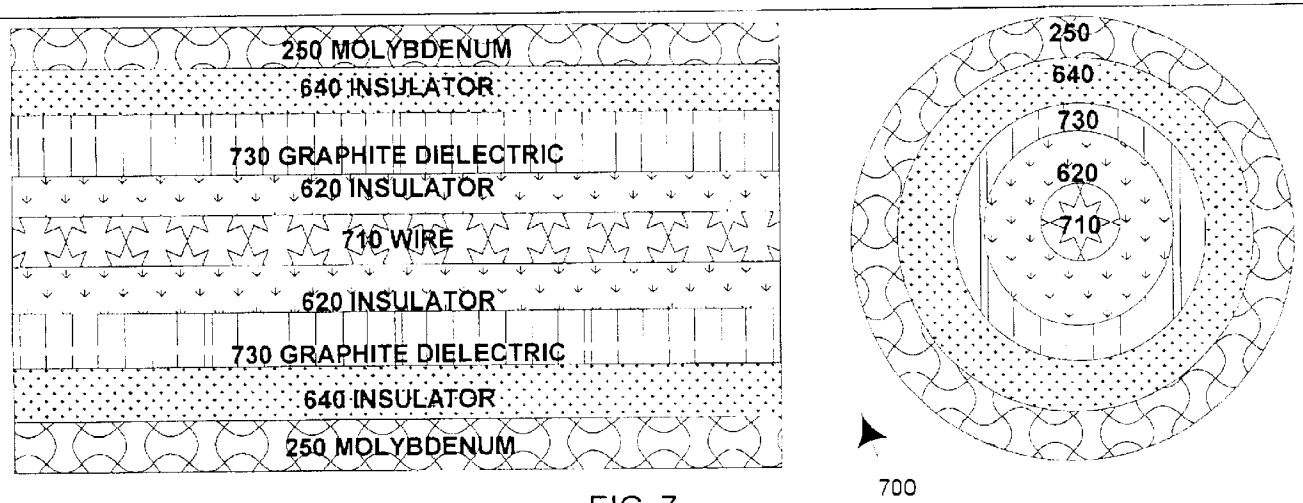
FIG. 7 is a block diagram of an apparatus implementation of a radio-frequency driven dielectric heater including layers comprising certain materials and including insulators surrounding a conducting dielectric.

FIG. 7 is a block diagram of an apparatus implementation of a RF driven dielectric heater 700 having layers that comprise certain materials and including insulators surrounding a conducting dielectric. In the RF driven dielectric heater 700, the conductor 110 of FIG. 6 is a wire 710. Furthermore, the conducting dielectric 630 of FIG. 6 is a graphite dielectric 730. Lastly, the Faraday shield 150 of FIG. 6 is a molybdenum tube 250.

The graphite dielectric 730 necessitates electrical insulation around the outer and inner sides of the graphite dielectric 730. The graphite dielectric 730 is a poor insulator. Thus, a short will develop between the wire 710 and the molybdenum tube 250. Therefore, an insulator is required between the wire 710 and the graphite dielectric 730, and an insulator is required between the graphite dielectric 730 and the molybdenum tube 250. Thus, the RF driven dielectric heater 700 provides a heater with high thermal output and relatively small physical size.

Figure 8:
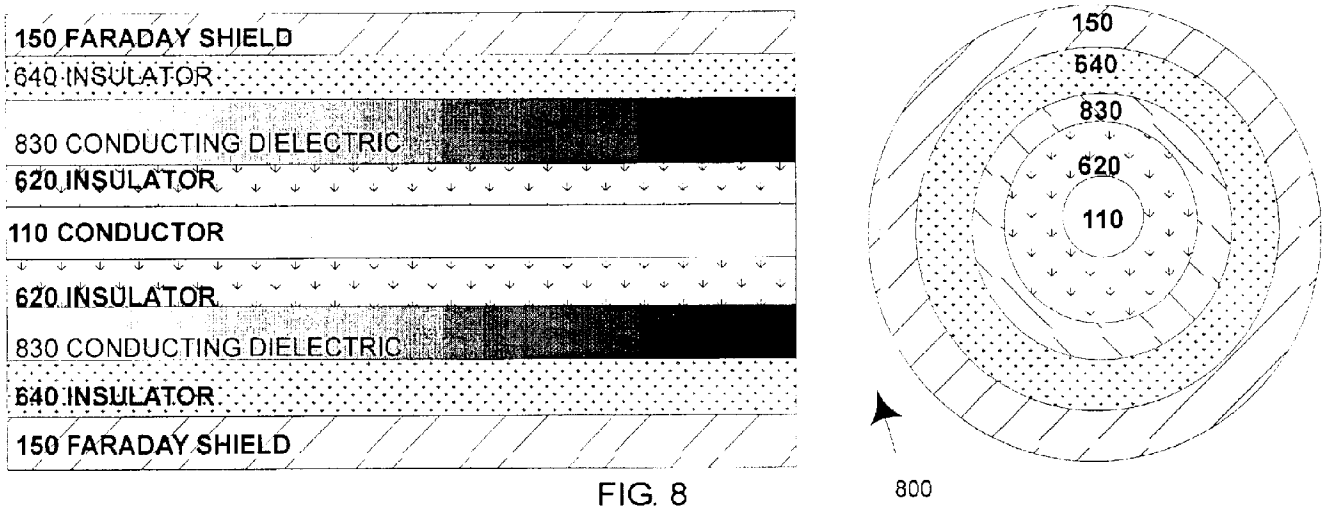
FIG. 8 is a block diagram of an apparatus implementation of a radio-frequency driven dielectric heater having a dielectric that varies along an axial dimension and including insulators surrounding a conducting dielectric.
Figure 9:
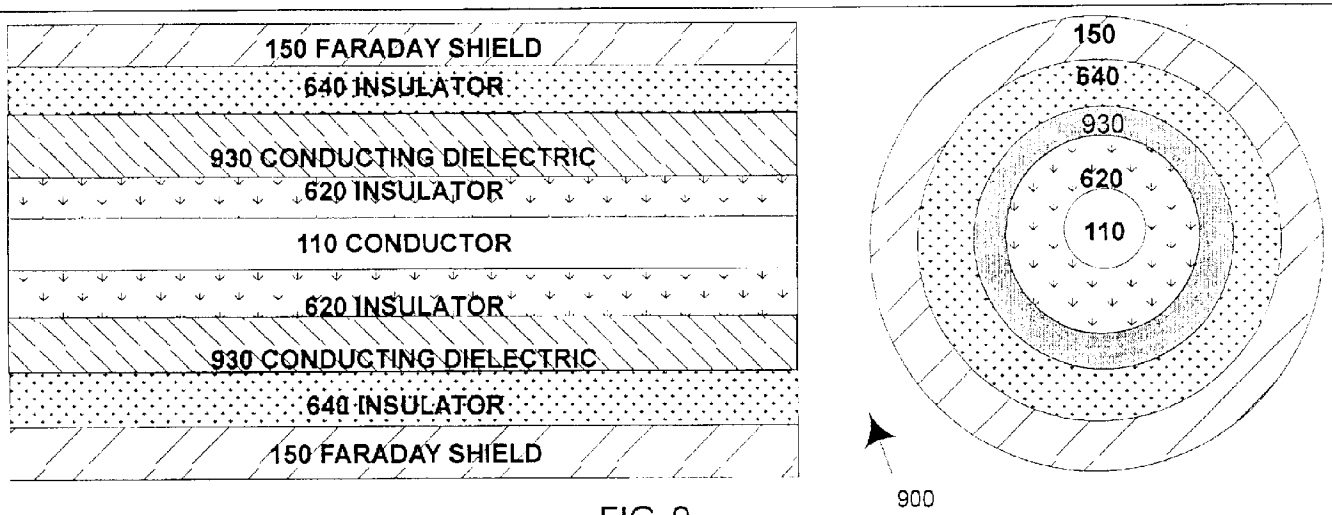
FIG. 9 is a block diagram of an apparatus implementation of a radio-frequency driven dielectric heater having a dielectric that varies along a radial dimension and including insulators surrounding a conducting dielectric.
Figure 10:
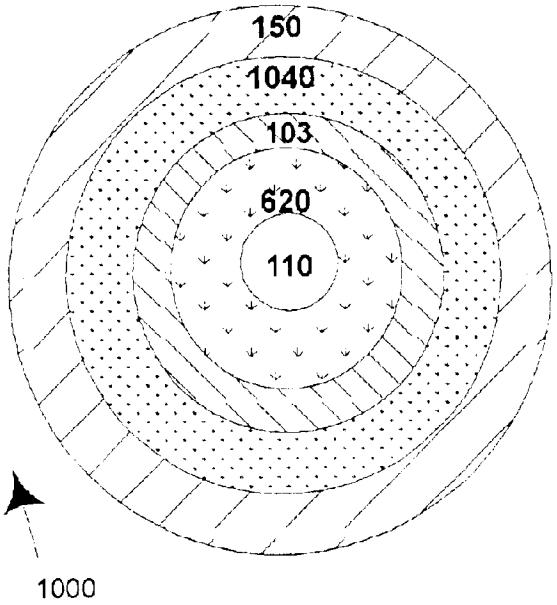
FIG. 10 is a block diagram of an apparatus implementation of a radio-frequency driven dielectric heater having a dielectric that varies geometrically along a dimension and including insulators surrounding a conducting dielectric.
Figure 10:
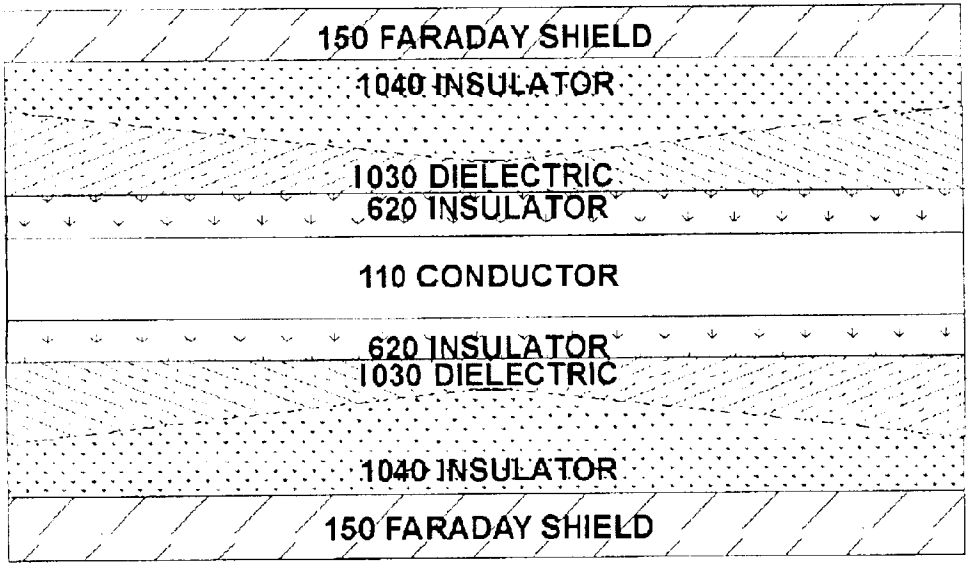

FIGS. 8–10 show RF driven dielectric heaters having insulators surrounding a conducting dielectric with variable thermal energy deposition.

FIG. 8 is a block diagram of an apparatus implementation of a RF driven dielectric heater 800 having a conducting dielectric that varies along an axial dimension. The RF driven dielectric heater 800 includes a conductor 110 and a Faraday shield 150 as in FIG. 6. However, the RF driven dielectric heater 800 also includes a conducting dielectric 830 that varies along an axial dimension. The conducting dielectric 830 varies in density of dielectric material along the axial dimension to create a thermal energy deposition that increases from one end of the axial dimension to the other end of the axial dimension.

FIG. 9 is a block diagram of an apparatus implementation of a radio-frequency driven dielectric beater 900 having a conducting dielectric that varies along a radial dimension. The RF driven dielectric heater 900 includes a conductor 110 and a Faraday shield 150 as in FIG. 6. However, the RF driven dielectric heater 900 also includes a conducting dielectric 930 that varies along a radial dimension. The conducting dielectric 930 varies in density of dielectric material outward from the center to create a thermal energy deposition that decreases outwardly from the center.

FIG. 10 is a block diagram of an apparatus implementation of a RF driven dielectric heater 1000 having a conducting dielectric that varies geometrically along an axial dimension. The RF driven dielectric heater 1000 includes a conductor 110 as in FIG. 6. However, the RF driven dielectric heater 1000 also includes a conducting dielectric 1030 that varies in thickness along an axial dimension to create a thermal energy deposition that is greatest in the middle along the axial dimension. In some embodiments, the RF driven dielectric heater 1000 also includes an insulator 1040 that varies in thickness in inverse proportion to the conducting dielectric 1030 along an axial dimension in order to maintain a constant thickness of the RF driven dielectric heater 1000 in accommodation to the conducting dielectric 1030. The RF driven dielectric heater 1000 is particularly well-suited to simulate the thermal energy deposition of fission reactors that have the greatest thermal energy deposition in the middle along an axial dimension.

Figure 11:
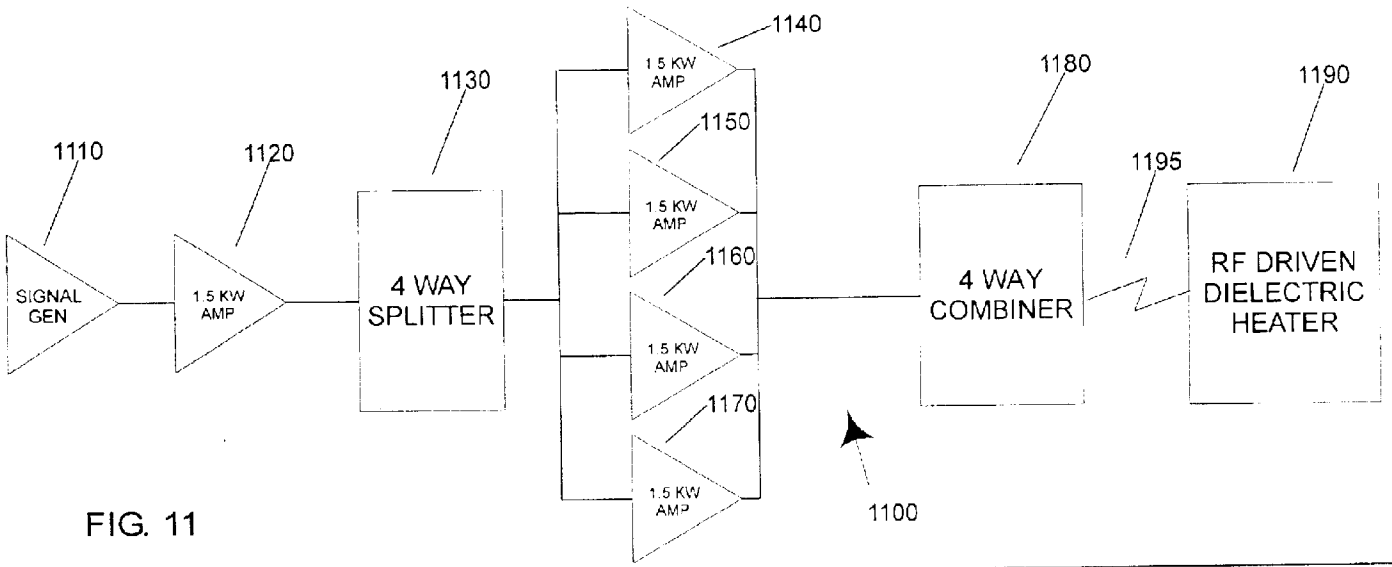
FIG. 11 is a block diagram of an apparatus implementation of an electrical circuit that provides electrical energy to a radio-frequency driven dielectric heater.

FIG. 11 is a block diagram of an apparatus implementation of an electrical circuit 1100 that provides electrical energy to a RF driven dielectric heater. The electrical circuit 1100 includes a signal generator 1110 electrically coupled to a 1.5 kW amplifier 1120. The electrical circuit 1100 also includes two electrically identical combiners 1130 and 1180. The first combiner, 4 way splitter 1130, is used as a splitter to provide four equal drive signals from the 1.5 kW amplifier 1120 to four 1.5 kW amplifier modules 1140, 1150, 1160 and 1170. The second combiner 1180 takes the output of the four modules 1140, 1150, 1160 and 1170 and combines the output into a single RF signal. Electrical circuit 1100 yields the RF signal in a desired voltage output such as 2,000 to 5,000 volts with RF frequencies up to 50 MHz.

The RF signal is transmitted to a RF driven dielectric heater 1190 through transmission medium 1195. Examples of the RF driven dielectric heater 1190 include RF driven dielectric heaters 100, 200, 300, 400, 500, 600, 700, 800, 900 and 1000. In some embodiments, the transmission medium is an electrically conductive physical wire, such as a copper wire. In other embodiments, the transmission medium 1195 includes a capacitive coupling means. In yet other embodiments, the transmission medium 1195 includes an inductive coupling means. The capacitive and inductive coupling means provide a means of transmitting the RF signal without a physical connection to the RF driven dielectric heater 1190. The lack of a physical connection increases the thermal isolation of the RF driven dielectric heater 1190.

Figure 12:
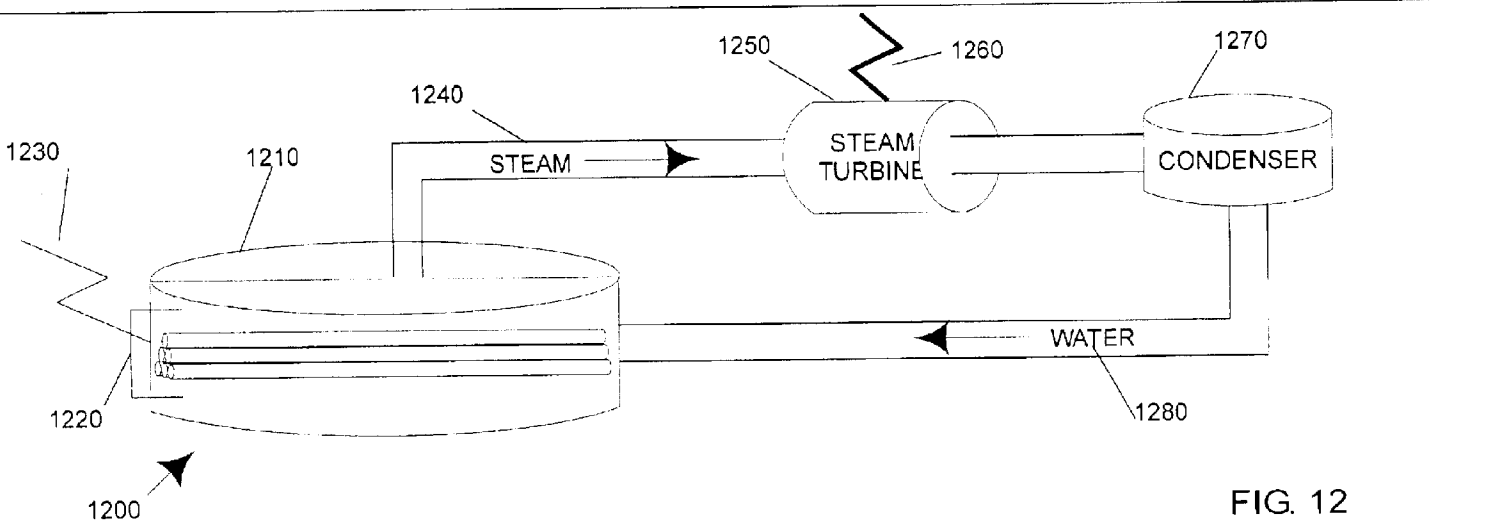
FIG. 12 is a block diagram of an apparatus for non-nuclear testing in nuclear core development that includes a radio-frequency driven dielectric heater.

FIG. 12 is a block diagram of an apparatus 1200 for non-nuclear testing in nuclear core development that includes a RF driven dielectric heater. Apparatus 1200 includes a steam generator 1210. The steam generator 1210 is substantially full of water. The steam generator 1210 includes a plurality of RF driven dielectric beaters 1220 immersed in the water. The plurality of RF driven dielectric heaters 1220 are bundled in close proximity and typically require the same volume of physical space as a fission core. In some embodiments, the plurality of RF driven dielectric heaters 1220 are electromagnetically coupled 1230 to a thermally isolated power source (not shown). Thermal energy from the plurality of RF driven dielectric heaters 1220 vaporizes some of the water in the steam generator 1210, yielding pressurized steam 1240. The pressurized steam drives a steam turbine electrical generator 1250, yielding electricity 1260. The waste steam is cooled to a liquid state 1280 by a condenser 1270 and returned to the steam generator 1210. In the aggregate, the steam generator 1210, the steam turbine electrical generator 1250 and condenser 1270 are also known as a power converter. Thus, apparatus 1200 satisfies the need to generate high thermal energy in a relatively small space to simulate fission reaction for non-nuclear testing in nuclear core development.

Figure 13:
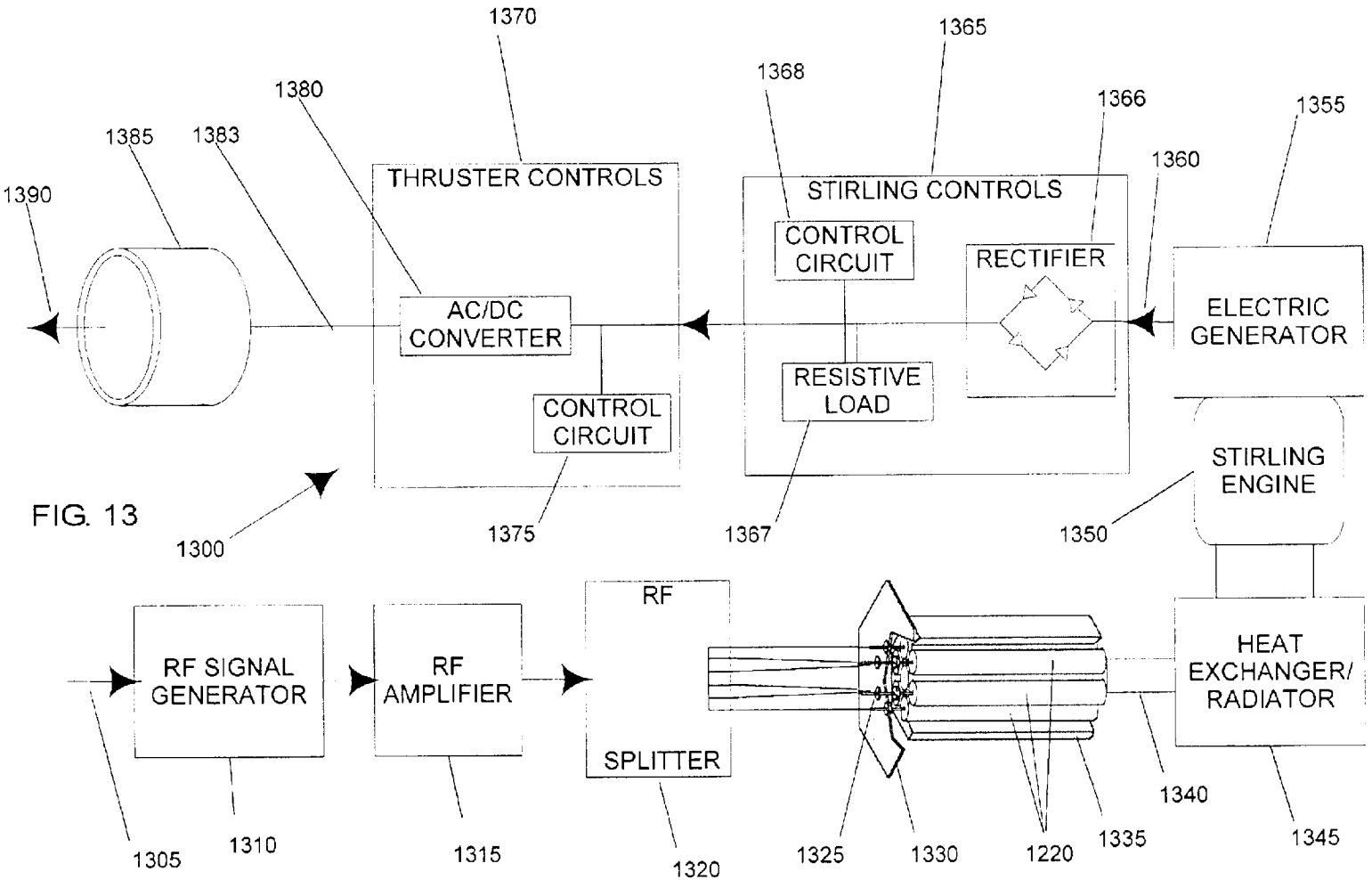
FIG. 13 is a block diagram of an apparatus for non-nuclear testing in nuclear core development that includes a radio-frequency driven dielectric heater.

FIG. 13 is a block diagram of an apparatus for non-nuclear testing in nuclear core development that includes a RF driven dielectric heater. Apparatus 1300 receives alternating current (AC) 1305 into an RF signal generator 1310. The RF signal generator 1310 transmits an RF signal to an RF amplifier 1315. An amplified RF signal is transmitted from the RF amplifier 1315 to an RF splitter 1320. Split RF signals are transmitted from the RF splitter 1320 through capacitive RF power coupling 1325. The capacitive RF power coupling 1325 is mounted in a thermal barrier 1330 that encapsulates a plurality of RF driven dielectric heaters 1220. The thermal barrier 1330 also encapsulates a refractory core 1335. A heat pipe 1340 transfers material that is heated in the refractory core 1335 to a heat exchanger 1345. Thermal energy from the heat exchanger 1345 is transferred to a Stirling Engine 1350. The Stirling Engine 1350 powers an electrical generator 1355. The electrical generator 1355 produces an alternating current (AC) 1360. The AC is transmitted to a Stirling Control 1365.

The Stirling Control 1365 includes a rectifier 1366 that converts the AC to direct current (DC) 1383. The Stirling Control 1365 also includes a resistive load 1367 and a control circuit 1368. The DC 1383 exits the Stirling Control 1365 and enters a thruster control 1370. The thruster control 1370 includes a control circuit 1375 and a DC/DC converter 1380 to convert the DC 1383 to a required voltage and current. The DC 1383 is received by an ion thruster 1385, providing thrust 1390. Thus, apparatus 1300 satisfies the need to generate large amounts of thermal energy in a relatively small space to simulate a fission reactor in non-nuclear testing.

Conclusion

A radio-frequency (RF) driven dielectric heater has been described. Although specific embodiments have been illustrated and described herein, it will be appreciated by those of ordinary skill in the art that any arrangement which is calculated to achieve the same purpose may be substituted for the specific embodiments shown. The RF driven dielectric heater is not limited to any particular conductor, dielectric and/or insulator. For sake of clarity, simplified conductors, dielectrics, insulators and/or Faraday shields have been described. This application is intended to cover any adaptations or variations of the present RF driven dielectric heater. In particular, one of skill in the art will readily appreciate that additional layers of materials may be disposed between any two layers of materials to isolate the layers of two materials that would become reactive in direct contact at high temperature without departing from the scope of embodiments of the radio-frequency driven dielectric heater. The additional materials may be selected to ensure the dielectric heating occurs primarily in the dielectric material. The additional layers of material may also include non-solid forms of matter such as a gas interface, or a liquid interface, depending on the particular requirements. One of skill in the art will readily recognize that embodiments of the radio-frequency driven dielectric heater are applicable to future non-nuclear core development.

The terminology used in this application with respect to is meant to include all dielectric and heater environments and alternate technologies which provide the same functionality as described herein. Therefore, it is manifestly intended that this radio-frequency driven dielectric heater be limited only by the following claims and equivalents thereof.

We claim:

1. A cylindrical dielectric heater comprising:

a substantially cylindrical electrical conductor, the substantially cylindrical electrical conductor being operable to generate a radio-frequency electromagnetic field;

a substantially cylindrical dielectric surrounding the conductor; and a substantially cylindrical Faraday shield surrounding the dielectric.

2. The cylindrical dielectric heater of claim 1, wherein the substantially cylindrical dielectric further comprises a substantially cylindrical insulating dielectric.

3. The cylindrical dielectric heater of claim 1, wherein the substantially cylindrical dielectric varies in a composition of at least one dielectric material along a dimension.

4. The cylindrical dielectric heater of claim 3, wherein the dimension further comprises a radial dimension.

5. The cylindrical dielectric heater of claim 3, wherein the dimension further comprises an axial dimension.

6. The cylindrical dielectric heater of claim 1, wherein the substantially cylindrical dielectric has a dimension that varies in a density of a dielectric material.

7. The cylindrical dielectric heater of claim 6, wherein the dimension further comprises a radial dimension.

8. The cylindrical dielectric heater of claim 6, wherein the dimension further comprises an axial dimension.

9. A dielectric heater comprising:

an electrical conductor being operable to produce an alternating electromagnetic field from a radio-frequency signal;

a dielectric within range of the alternating electromagnetic field, the dielectric having a characteristic that yields a variable thermal energy deposition; and a Faraday shield disposed opposite from the electrical conductor.

10. The dielectric heater of claim 9, wherein the dielectric varies in a composition of at least one dielectric material along a dimension.

11. The dielectric heater of claim 10, wherein the dimension further comprises a radial dimension.

12. The dielectric heater of claim 10, wherein the dimension further comprises an axial dimension.

13. The dielectric heater of claim 9, wherein the dielectric has a dimension that varies in a density of a dielectric material.

14. The dielectric heater of claim 13, wherein the dimension further comprises a radial dimension.

15. The dielectric heater of claim 13, wherein the dimension further comprises an axial dimension.

16. The dielectric heater of claim 9, wherein the electrical conductor, the dielectric and the Faraday shield have a cylindrical shape.

* * * * *